US010939769B1

(12) United States Patent
Lu

(10) Patent No.: US 10,939,769 B1
(45) Date of Patent: Mar. 9, 2021

(54) HEADREST ANGLE ADJUSTER

(71) Applicant: Dongguan Weihong Smart Home Technology Co., Ltd., Guangdong (CN)

(72) Inventor: Wei Lu, Guangdong (CN)

(73) Assignee: DONGGUAN WEIHONG SMART HOME TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/738,342

(22) Filed: Jan. 9, 2020

(30) Foreign Application Priority Data

Sep. 9, 2019 (CN) ..... 201910850081.7
Nov. 1, 2019 (CN) ..... 201911064442.1

(51) Int. Cl.
*A47C 20/04* (2006.01)
*A47C 17/04* (2006.01)
*A47C 1/10* (2006.01)
*A47C 7/38* (2006.01)

(52) U.S. Cl.
CPC ..... *A47C 17/04* (2013.01); *A47C 7/38* (2013.01)

(58) Field of Classification Search
CPC ..... A47C 7/38; A47C 17/04; A47C 20/041; A47C 20/04; B60N 2/806
See application file for complete search history.

(56) References Cited

U.S. PATENT DOCUMENTS 7,306,287 B2 * 12/2007 Linardi ..... B60N 2/821 297/410
7,322,646 B2 * 1/2008 Jammalamadaka ... B60N 2/844 297/216.12
8,104,141 B2 * 1/2012 Yamashita ..... B60N 2/2352 16/239
9,282,827 B1 * 3/2016 Lu ..... A47C 20/041
9,399,421 B2 * 7/2016 Lu ..... A47C 7/38
9,861,204 B2 * 1/2018 Lu ..... A47C 7/38
10,308,153 B2 * 6/2019 Jeong ..... B60N 2/815
10,413,071 B2 * 9/2019 Lu ..... A47C 17/04
10,413,078 B2 * 9/2019 Lu ..... A47C 7/38
10,512,339 B2 * 12/2019 He ..... A47C 20/041
10,595,642 B2 * 3/2020 Liu ..... B60N 2/829
2009/0288270 A1 * 11/2009 Yamashita ..... A47C 7/38 16/239
2016/0040464 A1 * 2/2016 Lu ..... A47C 7/402 16/250
2016/0227934 A1 * 8/2016 Lu ..... A47C 7/38

(Continued)

*Primary Examiner* — Shin H Kim
(74) *Attorney, Agent, or Firm* — Shimokaji IP

(57) ABSTRACT

A headrest angle adjuster includes a first fixing member, a second fixing member, a gear, a flexible member, a floating positioning member, and an engaging member. The gear is configured on the first fixing member which is hinged to the second fixing member; one end of the floating positioning member is movably sleeved on the gear, a driving hole is provided on the floating positioning member, a locking hole is provided on the first fixing member, the engaging member is located in the driving hole and the locking hole, and the floating positioning member swings and pushes the engaging member to move toward a narrower end of the locking hole, thereby guiding the engaging member to engage with the gear. The headrest can be positioned at any angle, and the adjustment is silent to improve user experience.

10 Claims, 8 Drawing Sheets

(56) References Cited

U.S. PATENT DOCUMENTS

| | | | | |
|---|---|---|---|---|
| 2017/0144573 | A1* | 5/2017 | Jeong | B60N 2/815 |
| 2019/0021503 | A1* | 1/2019 | Lu | A47C 7/38 |
| 2019/0069682 | A1* | 3/2019 | Liu | A47C 20/041 |
| 2019/0090649 | A1* | 3/2019 | Lu | A47C 20/046 |
| 2020/0146452 | A1* | 5/2020 | Chen | A47C 7/38 |

* cited by examiner

HEADREST ANGLE ADJUSTER

RELATED APPLICATIONS

This application claims the benefit of priority to Chinese invention applications No. 201910850081.7 filed on Sep. 9, 2019, and No. 201911064442.1 filed on Nov. 1, 2019, which is hereby incorporated by reference in its entirety.

FIELD OF THE INVENTION

The present invention relates to a field of furniture parts, more particularly to a headrest angle adjuster that can be positioned at any angle position and is silent during adjustment.

BACKGROUND OF THE INVENTION

In the old style sofa, the position and the angle of the headrest relative to the sofa body are fixed and cannot be changed to fit different body shapes and sitting positions of consumers. In order to make consumers feel more comfortable, the headrest of the improved sofa is adjustable by simply configuring a hinge between the sofa body and the headrest, and then moving the headrest manually. However, the headrest by using such a simple hinge only can be adjusted from a fully retracted state to a fully unfolded state, instead in any angle position. The more complicated adjustment device with a built-in motor or electric push rod as the power can position the headrest at any angle position, but the built-in power makes the adjustment device larger in size and higher in cost, which is not desirable. In addition, there is another type of adjuster with a gear inside, which achieves the angle positioning by the cooperation of the gear and the engaging part. However, such an adjuster may generate large noises due to the continuous collision of the teeth in the engaging structure during adjustment, which brings a poor user experience.

Thus, it's necessary to provide a headrest angle adjuster that can position the headrest at any angle position and is silent during adjustment.

SUMMARY OF THE INVENTION

One objective of the present invention is to provide a headrest angle adjuster that can position the headrest at any angle position and is silent during adjustment.

To achieve the above objective, the present invention provides a headrest angle adjuster comprising a first fixing member, a second fixing member, a gear, a flexible member, a floating positioning member, and an engaging member having a tooth surface. The gear is configured on one end of the first fixing member, the second fixing member is hinged on the end of the first fixing member and adapted for driving the gear to rotate relative to the first fixing member by frictions; one end of the floating positioning member is movably sleeved on the gear, a driving hole is provided on the floating positioning member, a locking hole that is wedged is provided on the first fixing member, the engaging member is located in the driving hole and the locking hole, and the floating positioning member swings and pushes the engaging member to move to a narrower end of the locking hole, thereby guiding the engaging member to approach and then engage with the gear; the flexible member is circumferentially mounted on the gear and held between the floating positioning member and the first fixing member thereby applying frictions on the floating positioning member.

In comparison with the prior art, the second fixing member hinged to the first fixing member can swing forward or backward relative to the first fixing member so as to drive the gear due to frictions, and the floating positioning member is rotated by frictions applied by the flexible member which is respectively mounted on the gear and abutted against the floating position member. When the floating positioning member does not move or swings forward, the engaging member is separated from the gear without forming a locking structure, so that the second fixing member is free to swing forward relative to the first fixing member. When the second fixing member starts to swing backward, the floating positioning member swings backward and pushes the engaging member, causing the engaging member to engage with the gear under the guidance of the locking hole. At this time, the first fixing member, the engaging member and the gear form a locking structure to lock the gear, that is, the current angle position of the second fixing member can be maintained. In addition, since the engaging member does not engage with the gear during the forward swing of the second fixing member, the noise generated by the collision of the engaging structure can be avoided. By this token, the headrest angle adjuster can realize the angle adjustment of the headrest and the positioning at any angle position, and achieve a silent adjustment and improve the user experience. Furthermore, since the transmission between the second fixing member and the gear is achieved by frictional forces, the second fixing member can also swing backward from any angle position once the reverse force applied to the second fixing member is greater than the friction forces, which makes the adjustment operation more convenient.

Preferably, the adjuster further includes a friction plate held between the second fixing member and the gear, and the gear is driven by the friction plate when the second fixing member swings.

Preferably, the first fixing member comprises two first holding parts, the second fixing member comprises two second holding parts, two floating positioning members and two flexible members are provided, a middle of the gear is provided with a tooth surface, two ends of the gear is provided with a supporting part respectively, the two floating positioning members are movably formed on the two supporting parts, the two flexible members are pressed against the two floating positioning members, the two supporting parts respectively pass through the two first holding parts, and the two second holding parts are held at outer sides of the two first holding parts.

Preferably, the adjuster further includes a bolt and a nut connected with the bolt, and the bolt passes through the two first holding parts, the two second holding parts, the gear, the floating positioning member, and the flexible member, in turns.

Preferably, the adjuster further includes a left cover and a right cover that is covered together between the two second holding parts to cover the gear, the floating positioning member, the flexible member, and the two first holding parts.

Preferably, a positioning protrusion protruding toward the floating positioning member is provided at an inner side of the first holding part, one end of the floating positioning member is provided with a limiting protrusion protruding toward the first fixing member and elastically engaged at a position above or below the positioning protrusion, a force required to swing the floating positioning member forward so as to switch the position of the limiting protrusion is greater than frictions between the flexible member and the floating positioning member, and the engaging member is pushed to move toward a narrower end of the locking hole when the floating positioning member swings reversely.

Preferably, one end of the floating positioning member is connected with the gear, and the other end of the floating positioning member is provided with a strip-shaped elastic portion that is deformable and is bent at a middle thereof toward the first holding part to form the limiting protrusion, and the driving hole is located between the two ends of the floating positioning member.

Preferably, the first holding part is further provided with an unlocking hole, the limiting protrusion is moved to engage at the position above the positioning protrusion when one end of the engaging member slides into the unlocking hole.

More preferably, the end of the engaging member is protruded beyond the first fixing member, the second fixing member is provided with a first bulge for pushing one end of the engaging member into the unlocking hole, and a second bulge for pushing one end of the engaging member out of the unlocking hole.

Preferably, the flexible member is a ring-shaped slice structure and has a wave-shaped periphery.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
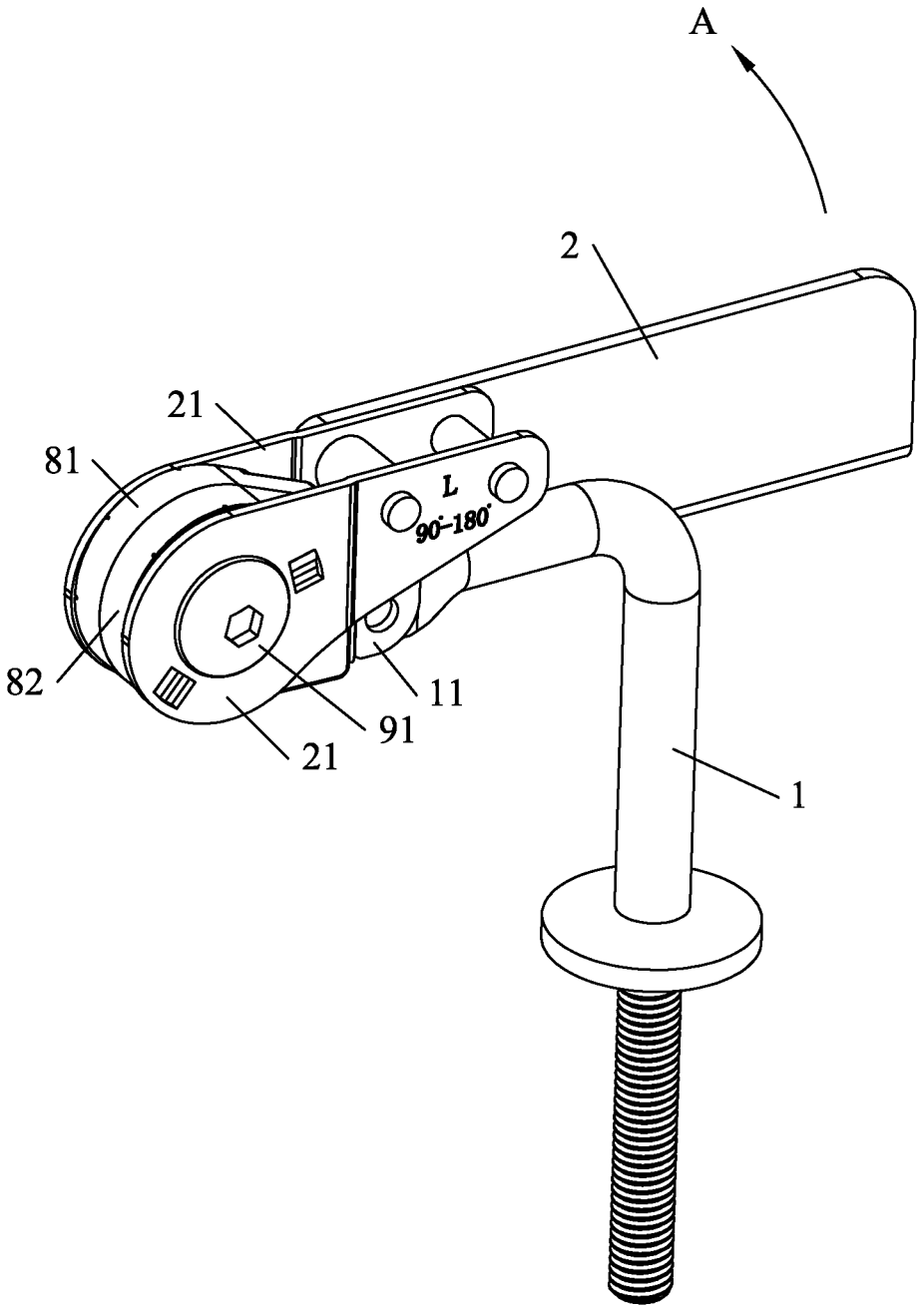
FIG. 1 is a perspective view of a headrest angle adjuster according to one embodiment of the present invention.
Figure 2:
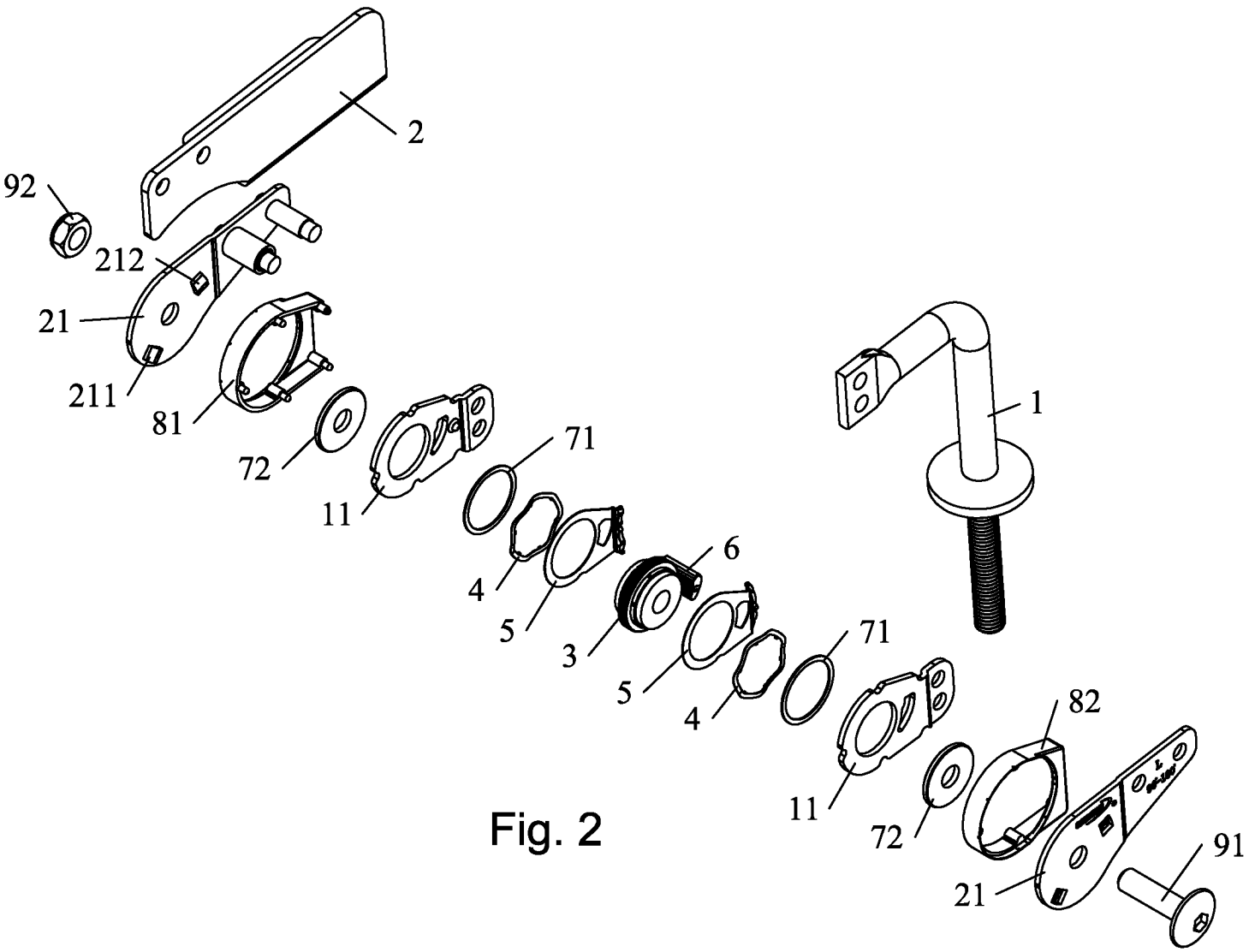
FIG. 2 is an exploded view of a headrest angle adjuster according to one embodiment of the present invention.
Figure 3:
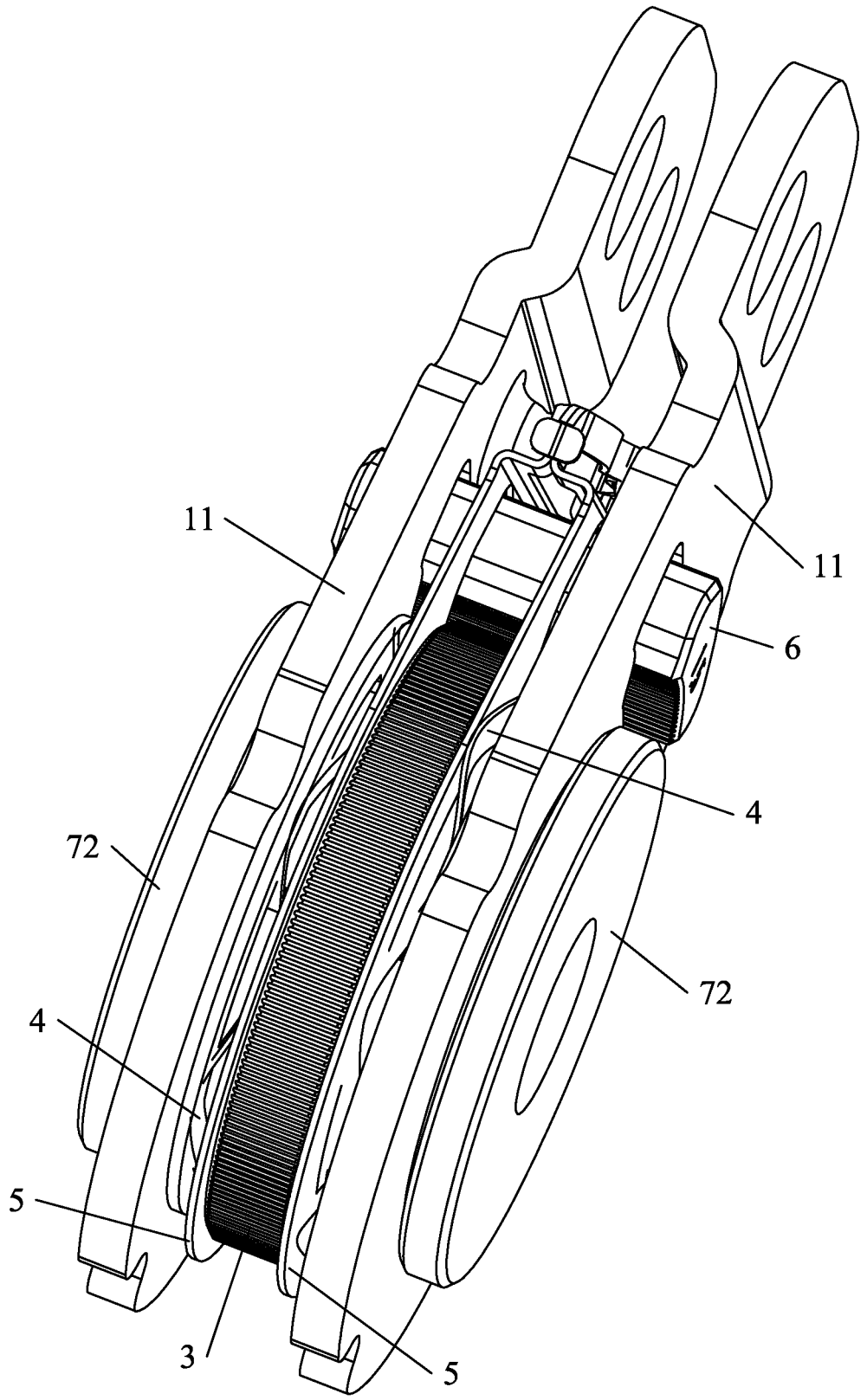
FIG. 3 shows the position relationship of the flexible member, the floating positioning member and the gear which are held between the two first holding parts.

As illustrated in FIGS. 1 to 3, a headrest angle adjuster according to one embodiment of the present invention is applicable to be installed between a sofa body and a headrest to adjust the angle of the headrest relatively to the sofa body. The headrest angle adjuster includes a first fixing member 1, a second fixing member 2, a gear 3, a flexible member 4, a floating positioning member 5, and an engaging member 6. The fixing member 1 is fixed to the sofa body, the second fixing member 2 is fixed to the headrest, and the second fixing member 2 is hinged to one end of the first fixing member 1 and swingable relatively to the first fixing member 1. In the present embodiment, the direction A shown in FIG. 1 is taken as a forward direction, the second fixing member 2 can swing forward from the lowest position shown in FIG. 1 to the highest position, and can also swing backward from the highest position to the lowest position. The gear 3 is provided in the end of the first fixing member 1 where is hinged to the second fixing member 2. When the second fixing member 2 swings, the gear 3 is driven to rotate relative to the first fixing member 1 by friction which is generated by the direct contact or indirect contact between the second fixing member 2 and the end face of gear 3. One end of the floating positioning member 5 is movably sleeved on the gear 3 so as to be swingable relative to the gear 3, with the swinging directions the same as the second fixing member 2.

For maintaining balance and steady, the hinge connection between the first fixing member 1 and the second fixing member 2 has a symmetrical structure. Specifically, the first fixing member 1 includes two first holding parts 11, the second fixing member 2 includes two second holding parts 21, and two floating positioning members 5 and two flexible members 4 are set.

Figure 4:
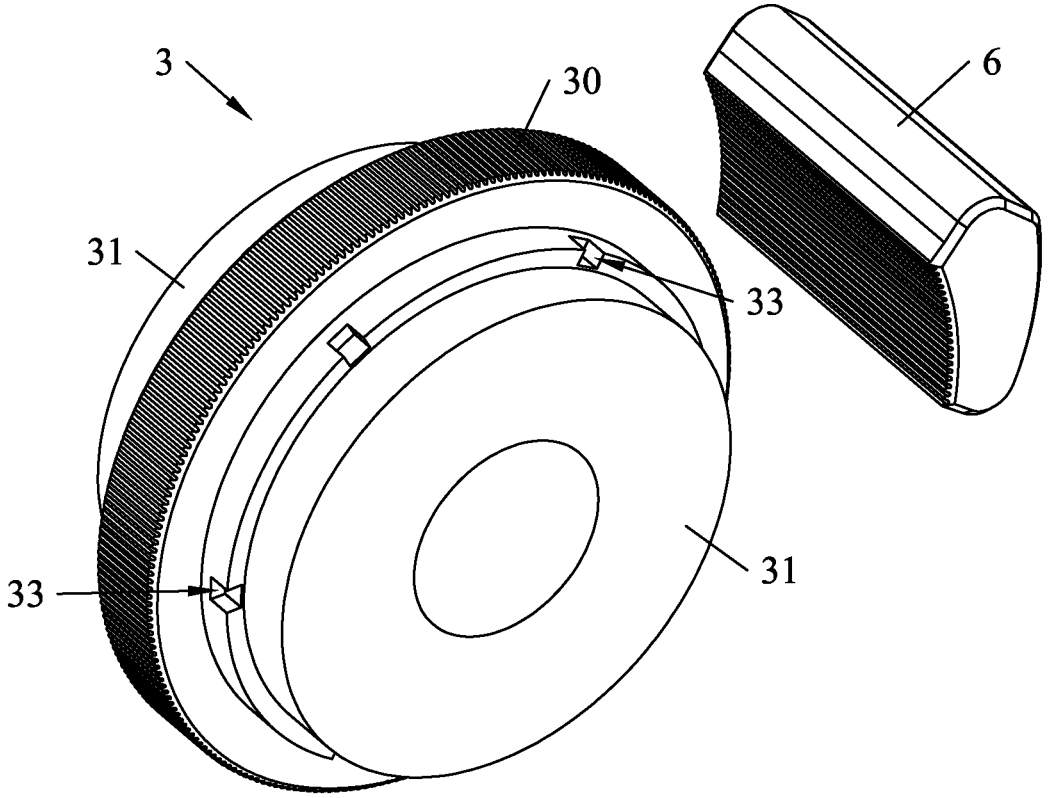
FIG. 4 is a perspective view of the gear and the engaging member.
Figure 5:
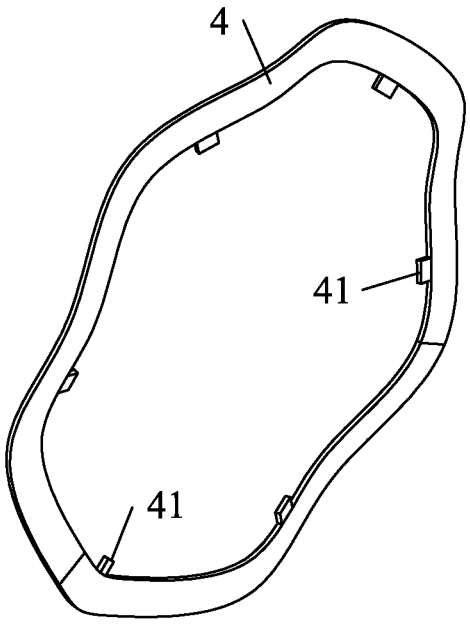
FIG. 5 is a perspective view of the flexible member.

As shown in FIG. 4, the middle portion of the gear 3 in the axial direction has a tooth surface 30 and the two ends of the gear 3 are provided with a supporting part 31, respectively, for supporting the floating positioning member 5, the flexible member 4 and the first holding parts 11. Specifically, the supporting part 31 is a frustum of a cone having a wider end at its inner end. As shown in FIG. 3, the gear 3 is located in the middle, and the two floating positioning members 5 are respectively sleeved on the inner ends of the two supporting parts 31, and the two flexible members 4 are also sleeved on the inner ends of the two supporting parts 31 and abut against the outside of the two floating positioning members 5. The two first holding parts 11 are sleeved on the outer ends of the two supporting parts 31 respectively. The flexible member 4 is clamped between the floating positioning member 5 and the first holding part 11 on the same side, so as to apply friction to the floating positioning member 5 by the clamping force. As shown in FIG. 5, the flexible member 4 is a ring-shaped slice structure and its periphery is wave-shaped. When the flexible member 4 is clamped and deformed to generate elastic restoring force by which the floating positioning member 5 is applied with frictions. At the same time, the flexible member 4 is not in overall contact with the floating positioning member 5 but only in a partial area, so that the relative motion between the flexible member 4 and the floating positioning member 5 is easier when the position of the floating positioning member 5 is restricted.

Figure 6:
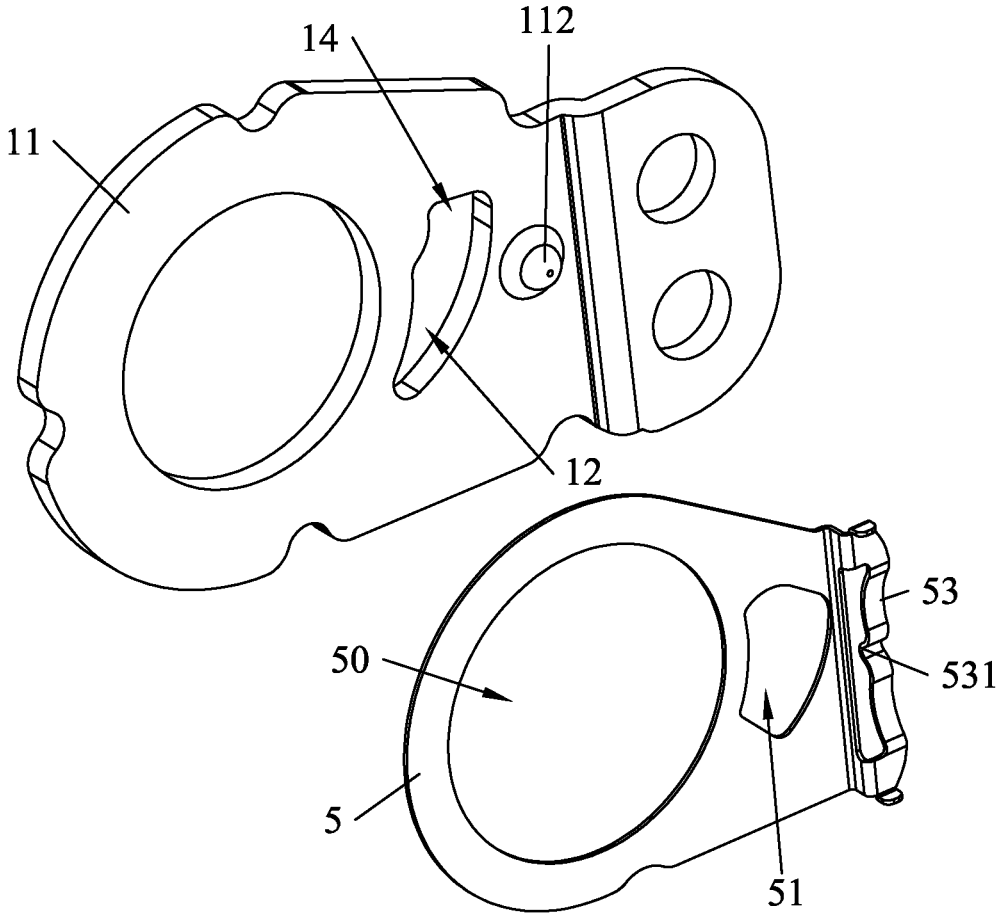
FIG. 6 is a perspective view of the first holding part and the floating positioning member.

Referring to FIGS. 3 and 6, the floating positioning member 5 is provided with a driving hole 51 for receiving the engaging member 6, that is, the engaging member 6 is located in the driving hole 51 and closely to the tooth surface 30 of the gear 3. The height of the driving hole 51 is slightly larger than the height of the engaging member 6, and the width is significantly larger than that of the engaging member 6. In such a way, the driving hole 51 can limit the engaging member 6 to a certain extent, when the floating positioning member 5 swings, the engaging member 6 can be driven to move accordingly; and at the same time, the engaging member 6 is allowed to move slightly to approach or move away from the gear 3 due to the width of the driving hole 51. The first holding part 11 of the first fixing member 1 is provided with a locking hole 12 opposite to the driving hole 51, and the locking hole 12 is wedge-shaped and therefore has a wider end and a narrower end. The engaging member 6 which is a wedge-shaped structure too is also located in the locking hole 12, and its locating position corresponds to the locking hole 12, that is, the narrower end of the engaging member 6 faces to the narrower end of the locking hole 12. The engaging member 6 has a tooth surface on the side facing the gear 3 and can be engaged with the gear 3 after contacting the gear 3.

The flexible member 4 is sleeved on the gear 3 in a circumferential direction. When the gear 3 rotates, the flexible member 4 rotates accordingly, and the flexible member 4 further causes the floating positioning member 5 to have a tendency to swing by friction. Specifically, as shown in FIG. 6, a plurality of notches 33 are provided along the circumferential direction at the inner end of the supporting parts 31 of the gear 3, and the flexible member 4 is provided with a plurality of locking bulges 41 protruding inwardly on the inner edge of the flexible member 4, as shown in FIG. 5. Specifically, the flexible member 4 is set on the supporting member 31, with the locking bulges 41 are respectively inserted into the corresponding notches 33, so as to achieve the circumferential positioning between the flexible member 4 and the gear 3.

Referring back to FIG. 2, the headrest angle adjuster further includes two gaskets 71, two friction plates 72, a left cover 81, a right cover 82, and a bolt 91 and a nut 92. The gasket 71 is sleeved on the supporting part 31 and is located between the first holding part 11 and the flexible member 4 to protect. The friction plate 72 is located outside the first holding part 11 and is clamped between the gear 3 and the second holding part 21, and the friction plate 72 is abutted against the end surface of the gear 3, and the friction of the second fixing member 2 on the gear 3 is exerted by the friction plate 72. The left cover 81 and the right cover 82 are penetrated in the axial direction. The left cover 81 and the right cover 82 are covered together between the two second holding parts 21 to cover the gear 3, the floating positioning member 5, the flexible member 4, and the outer periphery of the two first holding parts 11. The role of the left cover 81 and the right cover 82 is to protect the internal components and prevent outside objects from entering to affect the normal operation of the adjuster. The bolt 91 passes through all the components located between the two second holding parts 21 and is connected to the nut 92 by thread, and the locking force between the nut 92 and the bolt 91 determines the friction force between the second holding part 21 and the friction plate 72.

Referring to FIG. 6, the first holding part 11 is further provided with an unlocking hole 14 connected to the wider end of the locking hole 12. The width of the unlocking hole 14 is smaller than the wider end of the locking hole 12. Specifically, one end of the unlocking hole 14 where is far away from the gear 3 is connected to the locking hole 12, and the other end of the unlocking hole 14 is narrowed relative to the locking hole 12. In addition, a positioning protrusion 112 protruding toward the floating positioning member 5 is provided at the inner side of the first holding part 11. One end of the floating positioning member 5 is provided with a circular hole 50 for connection; the other end of the floating positioning member 5 is provided with a limiting protrusion 531 protruding toward the first fixing member 1. A driving hole 51 is located at the circular hole 50 and the limiting protrusion 531. The limiting protrusion 531 can be elastically engaged above or below the positioning protrusion 112. Specifically, the other end of the floating positioning member 5 is provided with a strip-shaped elastic portion 53 that is deformable and is bent at the middle toward the first holding part 11 to form the limiting protrusion 531. When the elastic portion 53 is deformed, the position of the limiting protrusion 531 can be switched between the upper and lower sides of the positioning protrusion 112. It should be noted that, the force required to swing the floating positioning member 5 so as to switch the position of the limiting protrusion 531 is greater than the friction between the flexible member 4 and the floating positioning member 5, that is, the floating positioning member 5 will not swing to switch the position of the limiting protrusion 531 by the friction between the flexible member 4 and the floating positioning member 5.

Referring back to FIGS. 2 and 3, the end of the engaging member 6 is protruded beyond the two first holding parts 11, and the second holding part 21 is provided with a first bulge 211 and a second bulge 212 protruded toward the first holding part 11. The first bulge 211 is used to push one end of the engaging member 6 from the locking hole 12 into the unlocking hole 14, and the second bulge 212 is used to push one end of the engaging member 6 out of the unlocking hole 14.

The working process of the headrest angle adjuster will be described below.

Figure 7:
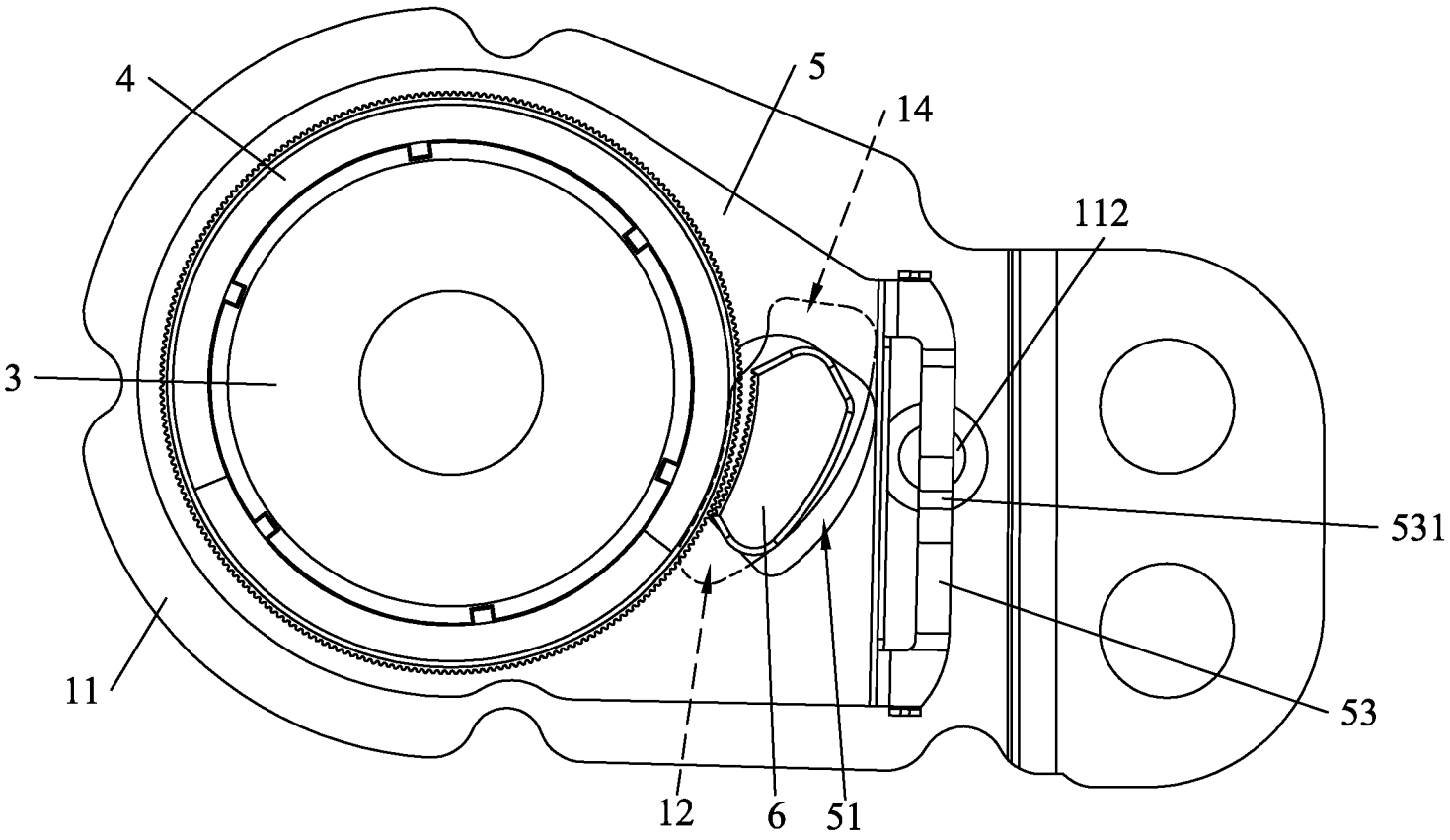
FIG. 7 is a view showing that the limiting protrusion is located below the positioning protrusion and the engaging member is not engaged with the unlocking hole.

As shown in FIGS. 1 and 7, when the second fixing member 2 is located at the lowest position, the limiting protrusion 531 of the floating positioning member 5 is caught below the positioning protrusion 112, and the engaging member 6 is located in the locking hole 12. When the second fixing member 2 swings forward relative to the first fixing member 1, the gear 3 rotates and applies a frictional force to the floating positioning member 5 through the flexible member 4, with such a frictional force less than the force for switching the limit protrusion 531 to reach the position that is located above the positioning protrusion 112, thus the floating positioning member 5 will not be driven, but the flexible member 4 rotates relative to the floating positioning member 5. At this time, the second fixing member 2 can swing freely relative to the first fixing member 1. When the second fixing member 2 swings in the opposite direction relative to the first fixing member 1, the floating positioning member 5 is driven to swing reversely (clockwise in FIG. 7) by means of the friction of the flexible member 4, as a result, the engaging member 6 moves at the narrower end of the locking hole 12 and then approaches and engages with the gear 3. After the engaging member 6 is engaged with the gear 3, the floating positioning member 5 cannot further swing, in fact, the swinging amplitude of the floating positioning member 5 is small. The gear 3 is also locked due to the engaging member 6 engaged between the gear 3 and the first holding part 11, and the second fixing member 2 is also locked and couldn't swing reversely due to the friction, thereby maintaining current position relative to the first fixing member 1. When the second fixing member 2 is swung forward in the locked state, the flexible member 4 drives the floating positioning member 5 to swing slightly until the limiting protrusion 531 contacts the positioning protrusion 112 and makes the engaging member 6 to disengage from the gear 3. When the reverse force applied to the second fixing member 2 is greater than the friction force between the second holding part 21 and the friction plate 72, the second fixing member 2 can be released from the friction plate 72 and the gear 3 and continues to swing reversely.

Figure 8:
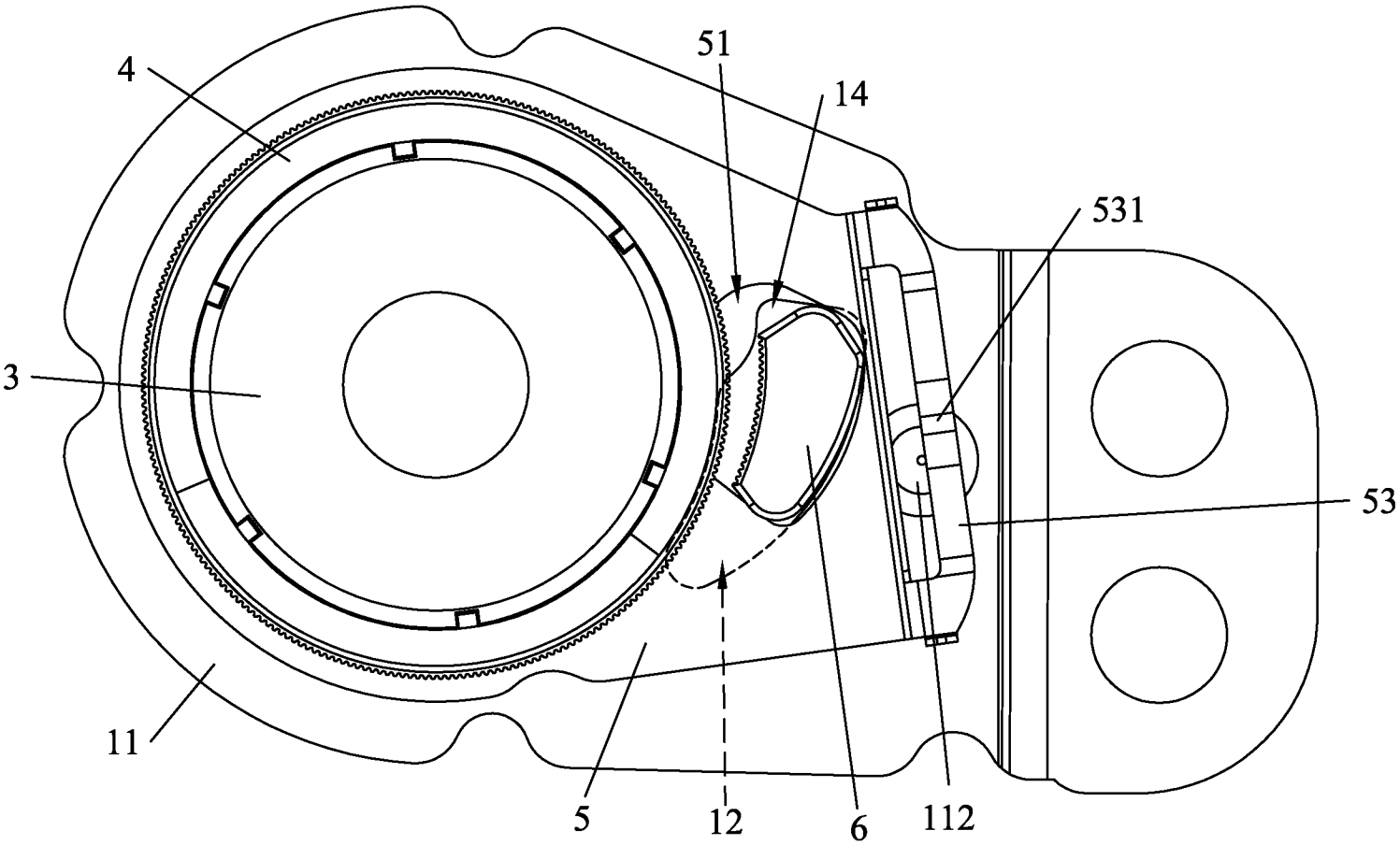
FIG. 8 is a view showing that the limiting protrusion is located above the positioning protrusion and the engaging member is engaged with the unlocking hole.

Referring to FIG. 8, when the second fixing member 2 swings forward to the highest position, the first bulge 211 shown in FIG. 2 contacts the engaging member 6 and pushes one end of the engaging member 6 into the unlocking hole 14 to keep the engaging member 6 away from the gear 3. Since the engaging member 6 is located in the driving hole 51, thus the floating positioning member 5 also will be driven to swing forward due to the upward movement of the engaging member 6, so that the limiting protrusion 531 is switched to the position above the positioning protrusion 112. In this state, the floating positioning member 5 cannot swing forward since the engaging member 6 is caught between the floating positioning member 5 and the first holding part 11, or swing reversely due to the restriction between the positioning protrusion 112 and the limiting protrusion 531. Because the gear 3 is not locked, the second fixing member 2 can swing freely in the forward or reverse direction relative to the first fixing member 1, and the gear will rotate along with the swinging thereof, and the flexible member 4 will rotate relative to the floating positioning member 5. When the second fixing member 2 swings back to the lowest position, the second bulge 212 shown in FIG. 2 contacts the engaging member 6 and pushes one end of the engaging member 6 out of the unlocking hole 14, and at the same time, the limiting protrusion 531 is moved to the lower side of the positioning protrusion 112, and the second fixing member 2 returns to the state where the reverse swing is locked.

By this token, after the headrest angle adjuster is installed between the sofa body and the headrest, the headrest can be adjusted freely in the forward direction, and maintained at the current angle position when a reverse force is applied, further the headrest can be adjusted reversely unless reverse force is large enough. In addition, after the headrest is adjusted to the highest position, the headrest can be adjusted in both forward and reverse directions by small force.

Compared with the prior art, the headrest angle adjuster can realize the angle adjustment of the headrest and the positioning at any angle position, since the engaging member 6 does not engage with the gear 3 during the adjustment process, thereby achieving a silent adjustment and improving the user experience.

While the invention has been described in connection with what are presently considered to be the most practical and preferred embodiments, it is to be understood that the invention is not to be limited to the disclosed embodiments, but on the contrary, is intended to cover various modifications and equivalent arrangement included within the spirit and scope of the invention.

What is claimed is:

1. A headrest angle adjuster, comprising a first fixing member, a second fixing member, a gear, a flexible member, a floating positioning member, and an engaging member having a tooth surface, wherein the gear is configured on one end of the first fixing member, the second fixing member is hinged on the end of the first fixing member and adapted for driving the gear to rotate relative to the first fixing member by frictions;

one end of the floating positioning member is movably sleeved on the gear, a driving hole is provided on the floating positioning member, a locking hole that is wedged is provided on the first fixing member, the engaging member is located in the driving hole and the locking hole, and the floating positioning member swings and pushes the engaging member to move to a narrower end of the locking hole, thereby guiding the engaging member to approach and then engage with the gear; and the flexible member is circumferentially mounted on the gear and held between the floating positioning member and the first fixing member thereby applying frictions on the floating positioning member.

2. The headrest angle adjuster according to claim 1, further comprising a friction plate held between the second fixing member and the gear, and the gear is driven by the friction plate when the second fixing member swings.

3. The headrest angle adjuster according to claim 1, wherein the first fixing member comprises two first holding parts, the second fixing member comprises two second holding parts, two floating positioning members and two flexible members are provided, a middle of the gear is provided with a tooth surface, two ends of the gear is provided with a supporting part respectively, the two floating positioning members are movably formed on the two supporting parts, the two flexible members are pressed against the two floating positioning members, the two supporting parts respectively pass through the two first holding parts, and the two second holding parts are held at outer sides of the two first holding parts.

4. The headrest angle adjuster according to claim 3, further comprising a bolt and a nut connected with the bolt, and the bolt passes through the two first holding parts, the two second holding parts, the gear, the floating positioning member, and the flexible member, in turns.

5. The headrest angle adjuster according to claim 3, further comprising a left cover and a right cover that is covered together between the two second holding parts to cover the gear, the floating positioning member, the flexible member, and the two first holding parts.

6. The headrest angle adjuster according to claim 1, wherein a positioning protrusion protruding toward the floating positioning member is provided at an inner side of the first holding part, one end of the floating positioning member is provided with a limiting protrusion protruding toward the first fixing member and elastically engaged at a position above or below the positioning protrusion, a force required to swing the floating positioning member forward so as to switch the position of the limiting protrusion is greater than frictions between the flexible member and the floating positioning member, and the engaging member is pushed to move toward a narrower end of the locking hole when the floating positioning member swings reversely.

7. The headrest angle adjuster according to claim 6, wherein one end of the floating positioning member is connected with the gear, and the other end of the floating positioning member is provided with a strip-shaped elastic portion that is deformable and is bent at a middle thereof toward the first holding part to form the limiting protrusion, and the driving hole is located between the two ends of the floating positioning member.

8. The headrest angle adjuster according to claim 6, wherein the first holding part is further provided with an unlocking hole, the limiting protrusion is moved to engage at the position above the positioning protrusion when one end of the engaging member slides into the unlocking hole.

9. The headrest angle adjuster according to claim 8, wherein the end of the engaging member is protruded beyond the first fixing member, the second fixing member is provided with a first bulge for pushing one end of the engaging member into the unlocking hole, and a second bulge for pushing one end of the engaging member out of the unlocking hole.

10. The headrest angle adjuster according to claim 1, wherein the flexible member is a ring-shaped slice structure and has a wave-shaped periphery.

* * * * *